United States Patent [19]

Schlinger

[11] 4,007,786

[45] Feb. 15, 1977

[54] SECONDARY RECOVERY OF OIL BY STEAM STIMULATION PLUS THE PRODUCTION OF ELECTRICAL ENERGY AND MECHANICAL POWER

[75] Inventor: Warren G. Schlinger, Pasadena, Calif.

[73] Assignee: Texaco Inc., New York, N.Y.

[22] Filed: July 28, 1975

[21] Appl. No.: 599,909

[52] U.S. Cl. ..... 166/266; 166/267; 166/272; 166/303; 60/39.02; 60/39.12

[51] Int. Cl.[2] ..... E21B 43/24; F02B 43/12

[58] Field of Search ..... 60/39.12, 39.18 B; 166/265–267, 272, 303; 299/4, 5; 48/196 R, 196 FM

[56] References Cited

UNITED STATES PATENTS

| | | | |
|---|---|---|---|
| 2,324,172 | 7/1943 | Parkhurst | 166/266 |
| 3,150,716 | 9/1964 | Strelzoff et al. | 166/272 |
| 3,704,587 | 12/1972 | Krieb et al. | 60/39.12 |
| 3,759,036 | 9/1973 | White | 60/39.12 |
| 3,827,243 | 8/1974 | Paull et al. | 166/272 |
| 3,866,411 | 2/1975 | Marion et al. | 60/39.12 |
| 3,868,817 | 3/1975 | Marion et al. | 60/39.12 |
| 3,873,845 | 3/1975 | Osthaus | 60/39.12 |
| 3,881,550 | 5/1975 | Barry | 166/266 |
| 3,916,617 | 11/1975 | McKenzie et al. | 60/39.12 |
| 3,918,521 | 11/1975 | Snavely et al. | 166/272 |

*Primary Examiner*—Stephen J. Novosad
*Attorney, Agent, or Firm*—T. H. Whaley; C. G. Ries; Albert Brent

[57] ABSTRACT

The subject process pertains to the secondary recovery of oil by the steam stimulation of an underground oil reservoir. As an added benefit, mechanical power and/or electrical energy may be simultaneously produced. In the subject process, raw fuel gas is first produced by the partial oxidation in a free-flow gas generator of a hydrocarbonaceous feed, such as preferably a portion of the oil recovered. The raw fuel gas is cleaned, purified, and burned in a gas turbine which drives a compressor or electric generator. The sensible heat in the raw fuel gas leaving the gas generator and in the flue gas discharged from the gas turbine is recovered by the production of high quality steam. This steam is injected into subterranean formations and reservoirs to accelerate production and to provide additional oil recovery.

17 Claims, 1 Drawing Figure

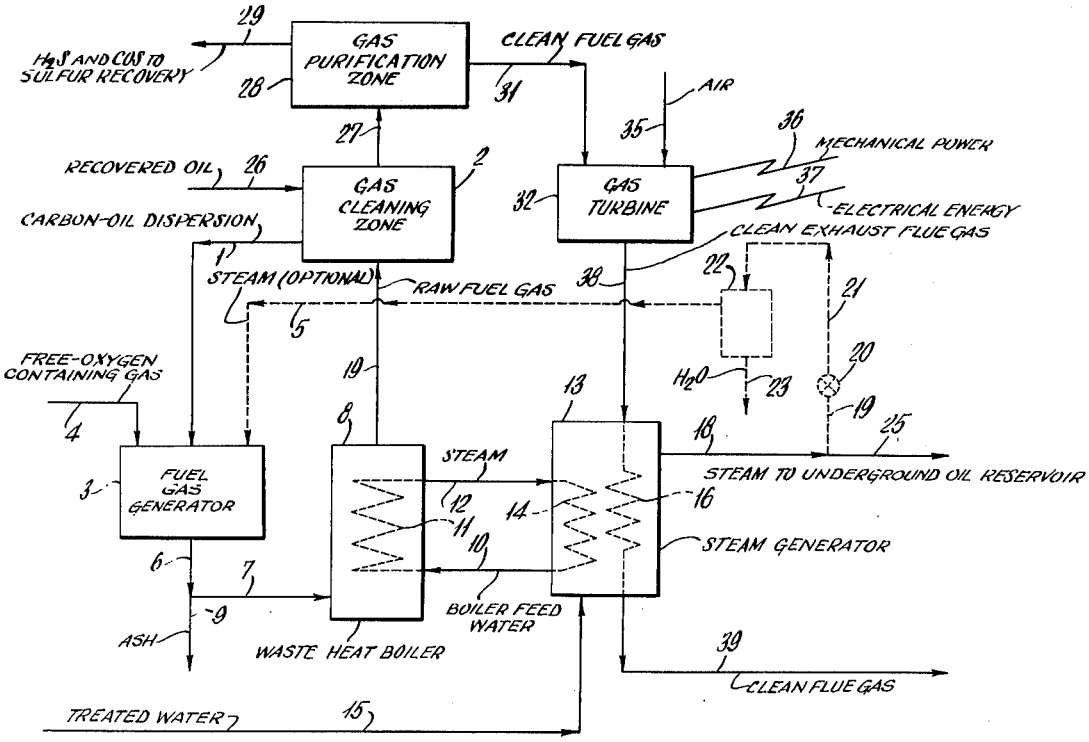

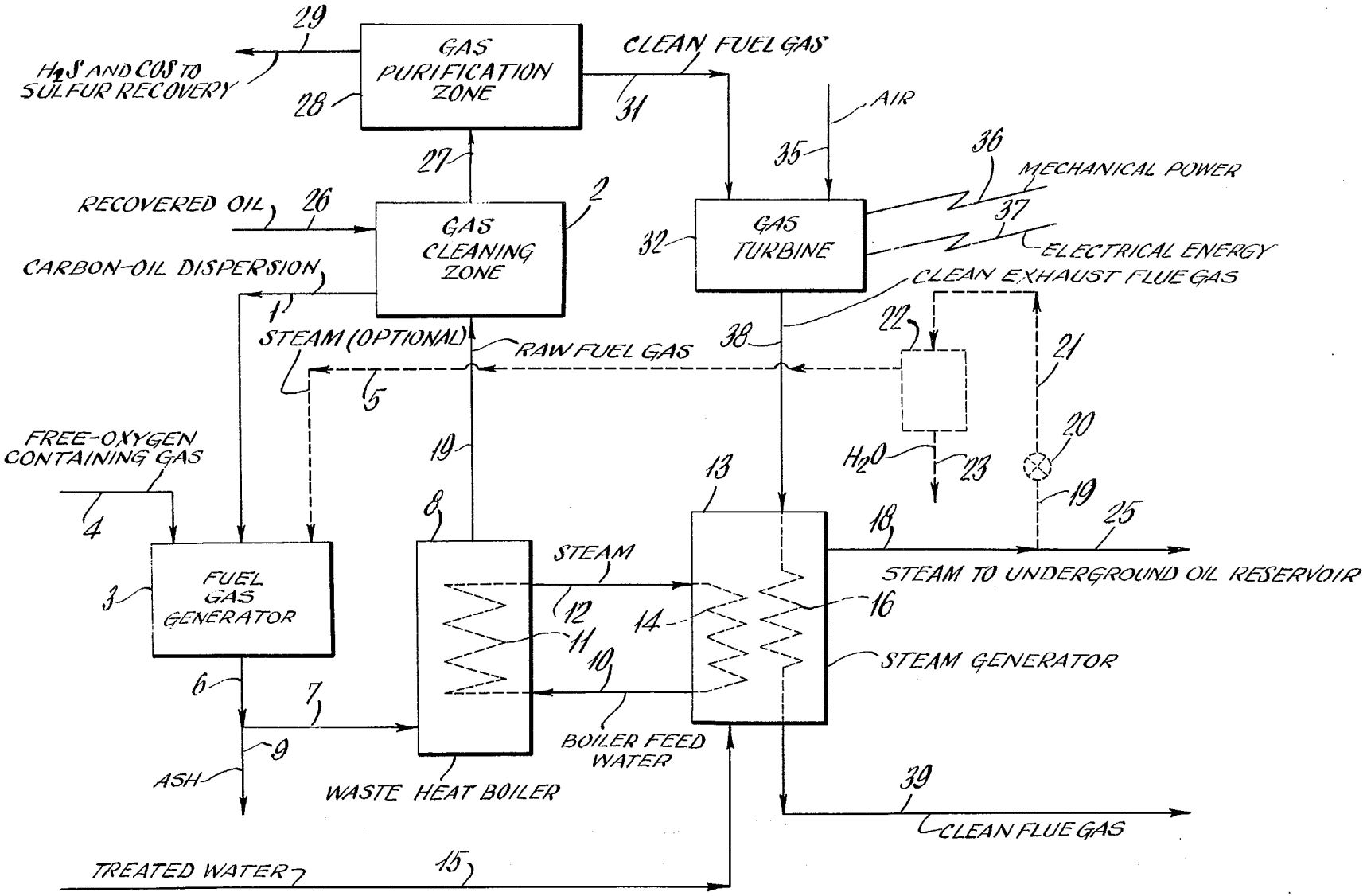
GAS PURIFICATION ZONE
GAS CLEANING ZONE
GAS TURBINE
FUEL GAS GENERATOR
WASTE HEAT BOILER
STEAM GENERATOR
CLEAN FUEL GAS
AIR
MECHANICAL POWER
ELECTRICAL ENERGY
CLEAN EXHAUST FLUE GAS
STEAM TO UNDERGROUND OIL RESERVOIR
CLEAN FLUE GAS
RAW FUEL GAS
STEAM (OPTIONAL)
STEAM
BOILER FEED WATER
$H_2O$
$H_2S$ AND CO2 TO SULFUR RECOVERY
RECOVERED OIL
CARBON-OIL DISPERSION
FREE-OXYGEN CONTAINING GAS
ASH
TREATED WATER

SECONDARY RECOVERY OF OIL BY STEAM STIMULATION PLUS THE PRODUCTION OF ELECTRICAL ENERGY AND MECHANICAL POWER

BACKGROUND OF THE INVENTION

1. Field of the Invention

This invention pertains to a process for the secondary recovery of oil from subterranean formations and reservoirs by steam stimulation. Mechanical power and/or electrical energy may be simultaneously produced as an added benefit of the process.

2. Description of the Prior Art

During the first or primary recovery period, natural earth pressures are relied upon to cause the oil to flow to the surface. Primary recovery may be continued until the reservoir pressure is reduced to a level where it is no longer economical to recover oil. Only about five to twenty-five percent of the oil in a reservoir may be obtained by primary recovery techniques.

A variety of secondary recovery processes have been employed in order to increase the recovery of oil from subterranean formations. For example, water, $CO_2$, air, and natural gas have been injected into underground oil reservoirs through an injection well in order to drive oil through the porous oil-bearing strata to a production well. Further, steam has been employed as a means of increasing the recovery of crude oil from relatively shallow reservoirs.

The production of fuel gas by the partial oxidaion of a hydrocarbonaceous fuel in a free-flow gas generator, and the burning of said fuel in a gas-turbine in described in coassigned U.S. Pat. No. 3,866,411.

SUMMARY

This process pertains to the production of high quality steam, and the secondary recovery of oil from subterranean formations and reservoirs by the injection of said steam underground. Further, mechanical power and/or electrical energy may be simultaneously produced in the process as an added benefit. Included are the steps of producing a raw fuel gas by the partial oxidation in a non-catalytic free-flow gas generator of a hydrocarbonaceous feed; cooling the raw fuel gas stream leaving the gas generator in a waste-heat boiler thereby producing steam; purifying said raw fuel gas in a gas purification zone to remove impurities e.g. particulate carbon, $H_2S$, COS; burning the clean fuel gas in the combustion chamber of a gas turbine to produce flue gas; discharging said flue gas through a turbine which drives a compressor and/or an electric generator; separately passing the hot exhaust gas from said turbine and the steam produced in said waste-heat boiler through a heat exchange zone in indirect heat exchange with treated water, thereby producing steam, e.g., 80% quality; injecting at least a portion of said steam into underground oil formations and reservoirs; recovering and separating oil and water from said underground formations and reservoirs; and treating at least a portion of said recovered water to obtain said treated water for making said steam in said heat exchange zone. Preferably, said hydrocarbonaceous feed to the partial oxidation fuel gas generator may be a carbon-oil dispersion produced in said gas purification zone from particulate carbon removed from said raw fuel gas and a portion of said recovered oil.

DESCRIPTION OF THE INVENTION

The present invention pertains to an improved continuous process for the secondary recovery of oil from subterranean formations and reservoirs by steam stimulation. As a bonus, mechanical power and/or electrical energy may be simultaneously produced.

In the subject process, an improved fuel gas is first produced having a heating value in the range of about 75 to 350 BTU/SCF (British Thermal Units per Standard Cubic Foot). After purificaion, the fuel gas is burned in the combustor of gas turbine and the clean flue gas is passed through an expansion turbine. Thermal, mechanical and electrical energy is thereby produced.

The fuel gas is produced by the partial oxidation of a hydrocarbonaceous feed with a free-oxygen containing gas, and optionally in the presence of a temperatue moderator in a conventional non-catalytic free-flow gas generator. The gas generator is preferably a vertical steel pressure vessel, such as described in coassigned U.S. Pat. No. 2,992,906 issued to F. E. Guptill, Jr.

A wide range of combustible carbon containing organic materials such as fossil fuels may be reacted in the gas generator to produce the fuel gas. Preferably, the hydrocarbonaceous fuel comprises at least a portion of the recovered oil. Alternatively, a portion of the recovered oil may be used in a subsequent gas purification zone to recover particulate carbon from the raw fuel gas leaving the gas generator. In such case, a carbon-oil dispersion may be produced and used as all or a portion of said hydrocarbonaceous feed.

The term hydrocarbonaceous as used herein to describe various suitable feedstocks is intended to include gaseous, liquid, and solid hydrocarbons, carbonaceous materials, and mixtures thereof. In fact, substantially any combustible carbon containing organic material, or slurries thereof, may be included within the definition of the term "hydrocarbonaceous." For example, there are (1) pumpable slurries of solid carbonaceous fuels, such as coal. particulate carbon, petroleum coke, concentrated sewer sludge, and mixtures thereof, (2) gas-solid suspensions, such as finely ground solid carbonaceous fuels dispersed in either a temperature-moderating gas or in a gaseous hydrocarbon, and (3) gas-liquid-solid dispersions, such as atomized liquid hydrocarbon fuel or water and particulate carbon dispersed in a temperature-moderating gas. The hydrocarbonaceous fuel may have a sulfur content in the range of about 0 to 10 weight percent and an ash content in the range of about 0 to 60 weight percent.

The term, liquid hydrocarbon, as used herein to describe suitable liquid feedstocks, is intended to include various materials, such as petroleum distillates and residues, kerosine, crude petroleum, asphalt, gas oil, residual oil, tar-sand oil and shale oil, coal oil, coal tar, cycle gas oil from fluid-catalytic-cracking operation, furfural extract of coker gas oil, and mixtures thereof. Gaseous hydrocarbon fuels, as used herein to describe suitable gaseous feedstocks, include water-gas, coke-oven gas, refinery gas, acetylene tail gas, ethylene off-gas, synthesis gas, and mixtures thereof. Both gaseous and liquid feeds may be mixed and used simultaneously and may include paraffinic, olefinic, naphthenic, and aromatic compounds in any proportion.

Also included within the definition of the term hydrocarbonaceous are oxygenated hydrocarbonaceous organic materials including carbohydrates, cellulosic materials, aldehydes, organic acids, alcohols, ketones, oxygenated fuel oil, waste liquids and by-products from chemical processes containing oxygenated hydrocarbonaceous organic materials and mixtures thereof.

The hydrocarbonaceous feed may be at room temperature, or it may be preheated to a temperature up to as high as about 600° to 1,200° F, but preferably below its cracking temperature.

A conventional burner axially mounted in the top head of the gas generator is generally used to introduce the hydrocarbonaceous feed as well as the other feedstreams into the reaction zone of the gas generator. The hydrocarbonaceous feed may be introduced into the burner in liquid phase or in a vaporized mixture with a temperature moderator. Suitable temperature moderators include $H_2O$, $CO_2$-rich gas, a portion of cooled clean exhaust gas from a gas turbine employed downstream in the process with or without admixture with air, by-product nitrogen from the air separation unit to be further described, and mixtures of the aforesaid temperature moderators.

The use of a temperature moderator to moderate the temperature in the reaction zone depends in general on the ash and oxygen content as well as the carbon to hydrogen ratio of the feedstock and the oxygen content of the oxidant stream. A temperature moderator may not be required with some gaseous hydrocarbon fuels; however, generally one is used with liquid hydrocarbon fuels and with substantially pure oxygen.

When the free-oxygen containing gas is air, a temperature moderator may not be necessary. As previously mentioned the temperature moderator may be introduced in admixture with either or both reactant streams. Alternatively, the temperature moderator may be introduced into the reaction zone of the gas generator by way of a separate conduit in the fuel burner.

When comparatively small amounts of $H_2O$ are charged to the reaction zone, for example through the burner to cool the burner tip, the $H_2O$ may be mixed with with either the hydrocarbonaceous feedstock, the free-oxygen containing gas, the temperature moderator, or combinations thereof. The weight ratio of water to hydrocarbonaceous feed may be in the range of about 0.0 to 1.0 and preferably 0.0 to less than 0.2.

The term free-oxygen containing gas, as used herein is intended to include air, oxygen-enriched air, i.e., greater than 21 mole % oxygen, and substantially pure oxygen, i.e. greater than 95 mole % oxygen, (the remainder comprising $N_2$ and rare gases). Free-oxygen containing gas may be introduced into the burner at a temperature in the range of about ambient to 1,800° F. The ratio of free oxygen in the oxidant to carbon in the feedstock (O/C, atom/atom) is preferably in the range of about 0.7 to 1.5.

The feedstreams are introduced into the reaction zone of the fuel gas generator by means of fuel burner. Suitably, an annulus-type burner, such as described in coassigned U.S. Pat. No. 2,928,460 issued to duBois Eastman, et al., may be employed.

The feedstreams are reacted by partial oxidation without a catalyst in the reaction zone of a free-flow gas generator at an autogenous temperature in the range of about 1,500° to 3,500° F. and at a pressure in the range of about 1 to 250 atmospheres absolute (atm. abs.) and preferably 10 to 180 atm. abs. The reaction time in the fuel gas generator is about 1 to 10 seconds. The mixture of effluent fuel gas leaving the gas generator may have the following composition (mole % -dry basis) if it is assumed that the rate gases are negligible: CO 15–57, $H_2$ 70–10, $CO_2$ 1.5–25, $CH_4$ 0.0–20, $N_2$ 0–75, $H_2S$ nil to 2.0 and CO nil to 0.1. Unreacted particulate carbon (on the basis of carbon in the feed by weight) is about 0.2 to 20 weight percent from liquid feeds but is usually negligible from gaseous hydrocarbon feeds.

The stream of hot effluent fuel gas leaving the gas generator is passed into a separate refractory lined steel chamber, preferably at a temperature in the range of about 1,500° to 3,500° F. as produced in the gas generator and about the same pressure, e.g., 10 to 180 atm. abs. and preferably 15 to 60 atm. abs. For example, spherical chamber such as described in coassigned U.S. Pat. No. 3,565,488 may be used. The spherical chamber is unpacked and free from obsturction to the flow of gas therein. A portion of the solid matter that may be entrained in the effluent stream of fuel gas drops out and may be removed by way of an outlet located at the bottom of the spherical chamber which leads to a lock hopper.

The stream of effluent fuel gas is then passed through an inline waste heat boiler in noncontact heat exchange with water. The stream of fuel gas is thereby cooled to a temperature in the range of about 300° to 750° F. by noncontact heat exchange with a concurrent stream of boiler-feed water. The water is converted into saturated steam having a temperature in the range of about 450° to 600° F. and a pressure in the range of about 400 to 1500 psig. This steam is passed into a steam generator as one of two heating fluids which are separately passed in indirect (noncontact) heat exchange with a stream of produced water (to be further described). The produced water is converted into steam having a quality of about 60 to 90%. The steam is then introduced into an underground oil reservoir to effect secondary recovery of oil. Optionally, a portion of the steam may be passed through a water separator and then introduced into the fuel gas generator as the temperature moderator. The condensed steam leaving the steam generator is recycled to said waste-heat boiler as said boiler feed water.

The cooled stream of fuel gas leaving the waste heat boiler is passed into a gas cleaning zone where particulate carbon and any other entrained solids may be removed therefrom. Slurries of particulate carbon in a liquid hydrocarbon fuel may be produced in the cleaning zone which may be recycled to the fuel gas generator as at least a portion of the feedstock. Any conventional procedure suitable for removing suspended solids from a gas stream may be used. For example, orifice and venturi scrubbing may be used. In one embodiment of the invention, the stream of fuel gas is introduced into a gas-liquid scrubbing zone where it is scrubbed with a scrubbing fluid such as liquid hydrocarbon or water. A suitable liquid-gas tray-type column is more fully described in Perry's chemical Engineer's Handbook, Fourth Edition, McGraw-Hill 1963, Pages 18–3 to 5.

Thus, by passing the stream of process fuel gas up a scrubbing column in direct contact and countercurrent flow with a suitable scrubbing fluid or with dilute mixtures of particulate carbon and scrubbing fluid flowing down the column, the particulate carbon may be removed from the fuel gas. A slurry of particulate carbon and scrubbing fluid is removed from the bottom of the column and may be sent to a carbon separation or concentration zone. This may be done by any conventional means that may be suitable, e.g., filtration, centrifuge, gravity settling, or by liquid hydrocarbon extraction such as the process described in the previously mentioned coassigned U.S. Pat. No. 2,992,906. Clean scrubbing fluid or dilute mixtures of scrubbing fluid and particulate carbon are recycled to the top of the column for scrubbing more fuel gas. As previously mentioned, it is preferable to use a portion of the readily available, low cost recovered oil in the gas cleaning zone. Thus recovered oil may be used as a scrubbing fluid, or the recovered oil may be used to resolve a naphtha-carbon dispersion when naphtha or some other light hydrocarbon is used as the scrubbing fluid. Oil works well in orifice scrubbers. Either way, the dispersion of particulate carbon and recovered oil that is produced is preferably introduced into the fuel gas generator as all or a portion of the hydrocarbonaceous feed.

Other suitable conventional gas cooling and cleaning procedures may be used in combination with or in place of the aforesaid scrubbing column. For example, the stream of fuel gas may be introduced below the surface of a pool of quenching and scrubbing fluid by means of a dip-tube unit. Or the stream of fuel gas may be passed through a plurality of scrubbing steps including an orifice-type scrubber or venturi or nozzle scrubber, such as shown in Perry's Chemical Engineer's Handbook, Fourth Edition, McGraw-Hill 1963, pages 18–54 to 56.

In a gas purification zone, a clean fuel gas comprising $H_2$, CO and one or more members of the group $CO_2$, $N_2$, $CH_4$, and $H_2O$ is produced. Thus, $CO_2$, $H_2S$, COS, $H_2O$, $NH_3$ and other gaseous impurities may be removed from the cooled and cleaned stream of gas leaving the gas cleaning zone. Suitable conventional processes may be used involving refrigeration and physical or chemical absorption with solvents, such as methanol, n-methylpyrrolidone, triethanolamine, propylene carbonate, or alternately with amines or hot potassium carbonate.

In solvent absorption processes, most of the $CO_2$ absorbed in the solvent may be released by a combination of boiling, flashing, and stripping. This may be done economically with nitrogen. Nitrogen may be available as a low cost by-product when a conventional air separation unit is used for producing substantially pure oxygen (95 mole % $O_2$ or more) for use as the oxygen-rich gas in the fuel gas generator. The regenerated solvent is then recycled to the absorption column for reuse. When necessary, final cleanup may be accomplished by passing the process gas through iron oxide, zinc oxide, or activated carbon to remove residual traces of $H_2S$ or organic sulfide.

Similarly, the $H_2S$ and COS containing solvent may be regenerated by flashing and stripping with nitrogen, or alternatively by heating and refluxing at reduced pressure without using an inert gas. The $H_2S$ and COS are then converted into sulfur by a suitale process. For example, the Claus process may be used for producing elemental sulfur from $H_2S$ as described in Kirk-Othmer Encyclopedia of Chemical Technology, Second Edition, Volume 19, John Wiley, 1969, Page 353. Excess $SO_2$ in the Claus plant tail gases may be removed and discarded in chemical combination with limestone, or by means of a suitable commercial extraction process. In general, the composition of the clean fuel gas in mole percent (dry basis) is about: $H_2$ 10 to 60, CO 15 to 60, $CH_4$ 0.0 to 25, $CO_2$ 0.0 to 20, $N_2$ 0.0 to 75. The Heat of Combustion is BTU/SCF is at least 70, suitably 75–350, and preferably 75 to 150, i.e., 90.

The stream of clean fuel gas from the gas purification zone is at a temperature in the range of about 100° to 800° F and at a pressure in the range of about 10 to 180 atm. abs. and preferably 15 to 60 atm. abs. Most preferably, the pressure of the fuel gas at this point is substantially the same as that produced in the fuel gas generator less ordinary line drop. Next, about 1.0 to 6.0 volumes of air are simultaneously introduced into the combustor of a gas turbine per volume of clean fuel gas. The preheated stream of clean fuel gas is then combusted with said air in said combustion chamber of a gas turbine.

When the air stream is introduced into the combustion chamber of the gas turbine at a temperature in the range of about 400° to 800° F and at substantially the same pressure as the fuel gas, the clean flue gas leaving the combustion chamber at a temperature in the range of about 1,400° to 3,000° F and usually 1,600° to 2,100° F, and at a pressure in the range of about 50 to 1,000 psig or higher and preferably 100 to 400 psig or higher has the following typical analysis in mole percent: $CO_2$ 4–10, $H_2O$3–10, $N_2$ 75–85, and $O_2$ 5–10. Only very small concentrations of oxides of nitrogen ($NO_2$) may be found in flue gas. This is due to the comparatively low temperature in the combustion chamber, which is primarily the result of the comparatively low adiabatic flame temperature of the improved fuel gas. Further, the $SO_2$ content of the flue gas is nil; and entrained particulates are negligible.

The clean flue gas leaving the combustion chamber is passed through at least one power-developing expansion turbine as the working fluid. Coupled through a variable-speed drive for example to the axis of the turbine and driven thereby may be at least one electric generator and at least one turbocompressor. The gaseous oxidizing stream prior to introduction into the combustion chamber of the gas turbine may be compressed by means of said turbocompressors to the proper pressure, e.g., over 10 to 70 atm. abs.

The clean exhaust flue gas leaves the main expansion turbine at a temperature in the range of about 800° to 1,200° F and a pressure in the range of about 1.0 to 7.0 atmospheres absolute. This stream of clean flue gas is then passed through said steam generator, as said second heating fluid is noncontact indirect heat heat exchange with said stream of produced water to produce said stream of steam. After heat exchange, the cooled clean exhaust flue gas may be discharged to the atmosphere by way of a stack. There is substantially no atmospheric pollution as the gaseous impurities were previously removed. Preferably, the stream of heat exchanged exhaust flue gas is vented or optionally further expanded in a power producing turbine.

Alternatively, the functions of the waste heat boiler and the steam generator may be combined in one vessel. In such case, the vessel would have three separate passages for the following: (1) raw fuel gas stream (hot); (2) clean exhaust flue gas stream from the expansion turbine (hot); and (3) suitably treated water stream (cold).

Alternatively, a pure water stream may be preheated to a temperature in the range of about 200° to 500° F by being passed in heat exchange with a portion of the hot clean flue gas stream in a first heat exchanger. This preheated water may be then converted into steam at a temperature in the range of about 450° to 600° F by heat exchange with the hot effluent gas stream from the fuel gas generator in a second heat exchanger.

Steam flooding makes it possible to add thermal and mechanical energy to a subterranean reservoir. This is due to the heat content and pressure of the injected steam. Steam is an ideal fluid for injecting underground. steam has a high heat content per pound. Further, the volume of 1 lb. of water is about 0.016 cu, ft., whereas 1 lb. of saturated steam at 358° F and 200 psi has a volume of 2.29 cu. ft.

Steam gives up heat to the formation and its fluids thereby dramatically decreasing the viscosity of the thick heavy crude, for example, 3000-fold. A reduction in viscosity makes the viscous crude more flowable in the reservoir matrix.

As the steam cools, it condenses into hot water which continues to displace the oil. Other advantages of steam injection include thermal swelling of the crude oil and steam distillation of residual oil in the pore spaces. The steam quality may range from about 50–100% and preferably 70–95%.

Steam may be injected underground by several techniques including "steam drive" and "steam soak". In the "steam drive" system, steam may be injected in a center well and fluids produced from surrounding wells. Optionally, the saturated section between the injector and producer wells may be fractured to establish communication. The injection well, for example, in a 5-spot pattern may be located in the center of a square at a distance up to about 300 feet from the producing corner wells. The amount of steam injected underground by way of the injection well depends upon such parameters as depth, formation temperature, oil viscosity, permeability and saturation. For example, from about 4000 to 100,000 lbs. of steam per hour may be injected at temperatures ranging from about 365° to 645° F. and at surface injection pressures in the range of about 150 to 2000 psig, and preferably 150 to 500 psig.

Downhole heat losses will vary with geothermal gradient, depth, casing, tubing, annulus geometry and thermal characteristics of the formation.

In the steam-soak method, steam is injected into a well for a certain period, e.g., up to 7 years, then stopped and the well put on the pump until production rates decline and the steam injection cycle can be repeated. Injection pressure may range from about 200 to 1500 psig. The amount of steam injected depends on such parameters as net sand thickness, porosity, oil viscosity, depth, etc.

Steam soak, by increasing well productivity, accelerating the pressure drop, and stimulating compaction, makes it possible to recover additional oil. Efficient production using steam soak has been obtained in areas of highly viscous oil not producible by primary means. The additional oil recovery is the result of various influences such as: thermal expansion, reactivation of solution-gas drive at higher temperatures, improvement of the drainage area, and oil displacement by water condensation. By alternately injecting steam into a well, then reversing to pump out hot fluids, immediate oil production is achieved.

The oil and water removed from the subterranean formation are separated. The water plus and surface make-up water is introduced into a water treating facility comprising a degasifier section, a sludge contact reactor, and gravity filters. Hardness (calcium and magnesium salts), alkalinity (bicarbonates and carbonates), silica, hydrogen sulfide, iron, oil and suspended solids are removed. The zeolite process or hot or cold lime process is used.

Thus bicarbonate may be removed by acidification and degassing. Calcium, magnesium and silica may be removed in a cold lime process utilizing a sludge blanket precipitator. Since this process operates at high pH, the iron also will precipitate out. The moderate amount of oil and turbidity will be absorbed in the sludge. Effluent water should be filtered in standard pressure or gravity filters.

DESCRIPTION OF DRAWING AND EXAMPLE

A more complete understanding of the invention may be had by reference to the accompanying schematic drawing which shows the previously described process in detail. Although the drawing illustrates a preferred embodiment of the porcess of this invention, it is not intended to limit the continuous process illustrated to the particular apparatus or materials described. Quantities have been assigned to the various streams so that the description may also serve as an example.

On an hourly basis, with reference to the drawing, about 143,000 lbs. of carbon-oil dispersion at a temperature of about 400° F in line 1 and containing about 2.1 wt. % (weight percent of particulate carbon are removed from gas cleaning zone 2 and introduced into fuel gas generator 3 by way of a conventional burner (not shown).

The oil in the carbon-oil dispersion is obtained subsequently in the process by secondary recovery (to be further described). The recovered oil has a heat of combusion of 18,300 BTU/lb., a gravity of 13°API, and the following ultimate analysis in wt. % C, 85.5, H, 11.3, O, 0.2, N, 0.8, S, 2.2.

A free-oxygen containing gas such as about 11,250,000 SCF of air at a temperature of about 570° F in line 4 is simultaneously introduced into the gas generator by way of said burner. 29,000 lbs. of steam in line 5 is introduced into the fuel gas generator.

Noncatalytic partial oxidation reaction takes place in the vertical, refractory lined, free-flow fuel gas generator at an autogenous temperature of about 2360° F and a pressure of about 600 psig.

About 16,200,000 SCF of effluent gas leaves the fuel gas generator by way of line 6 and passes through line 7 into waste heat boiler 8. The composition of the raw fuel gas in mole % follows: $H_2$, 15.6, CO, 20.8, $N_2$, 54.4, $CO_2$, 2.9, $H_2O$, 5.4, $H_2S$, 0.2, COS, 0.01, $CH_4$, 0.1, A, 0.6. About 2.5 weight % (basis carbon in hydrocarbonaceous feed) of particulate carbon is entrained in the effluent gas stream from the gas generator. Optionally, depending upon the ash content of the hydrocarbonaceous feed to the generator, at least a portion of the ash in the effluent gas stream may be removed by way of line 9 which leads to a lock-hopper system not shown.

In a closed loop, boiler feed water in line 10 enters waste heat boiler 8 at a temperature of 250° F. The water flows through coil 11 where it picks up heat from the effluent fuel gas stream passing on the outside and is converted into steam at a temperature of about 577° F. The steam leaves waste heat boiler 8 by way of line 12. It enters steam generator 13 and passes down through coil 14 in indirect heat exchange with treated water from line 15 and turbine exhaust in coil 16.

The steam in coil 14 is cooled by the aforesaid heat eachange and condensed. The resulting boiler-feed water is recycled to waste heat boiler 8 by way of line 10, thereby completing the loop. The treated water enters steam generator 13 at a temperature of about 200° F. The water passes up through steam generator 13 on the outside of coils 14 and 16 and leaves as steam having a quality of 80 percent by way of line 18.

Optionally, a portion of the steam in line 18 may be passed through line 19, valve 20, and line 21 into steam-water separator 22. Excess water in the steam is removed and leaves separator 22 by way of line 23. Steam may be then introduced into fuel gas generator 3 as the temperature moderator, by way of line 5.

About 1,800,000 lbs. of steam in line 25 having a quality of about 80% are introduced through a series of injection wells (not shown) into a subterranean reservoir to effect secondary recovery of oil. Simulatneously with the steam injection, a mixture comprising about 300,000 to 800,000 lbs. of oil and 1,800,000 lbs. per hour per water are removed by way of production wells (not shown).

After separation from the water, a portion of the recovered oil in line 26 is used in gas cleaning zone 2 as a scrubbing fluid to remove the particulate carbon from the raw fuel gas in a conventional manner, e.g., see co-assigned U.S. Pat. No. 3,639,261 – Slater.

The cleaned stream of raw fuel gas in line 27 is introduced into a gas purification zone 28 where by conventional techniques as previously described, $H_2S$, COS, and any other undesirable gaseous impurities are separated. $H_2S$ and COS are removed by way of line 29 and sent to the sulfur recovery unit (not shown).

16,150,000 SCF/hr of clean fuel gas at a temperature of about 120° F and comprising $H_2$, 15.6, CO, 20.8, $N_2$ and rare gases 55.2, $CO_2$, 2.9, $H_2O$, 5.4, $CH_4$, 0.1 are passed through line 31 into the combustor (not shown) of gas turbine 32. 23,700,000 SCF/hr of air in line 35 at a temperature of 600° F are simulaneously introduced into said combustor during the combustion of said clean fuel gas. The resulting flue gas leaves the combustor and is passed through an expansion turbine (not shown) as the working fluid. Mechanical power as represented by line 36, or electrical energy as represented by line 37, or both may be obtained by coupling compressors and electric generators (not shown) to the turbine shaft.

A stream of clean exhaust flue gas leaves the expansion turbine by way of line 38, at a temperature of 950° F. The hot gas is passed through coil 16 in steam generator 13 in noncontact indirect heat exchange with treated water from line 15, as previously discussed. The clean flue gas leaves steam generator 13 by way of line 39 at a temperature of 250° F. This stream of flue gas may be passed through a stack without polluting the atmosphere. Optionally, it may be introduced into the fuel gas generator as the temperature moderator.

Steam stimulation of a typical underground oil reversoir to prouduce 30,000 barrels/day of recovered oil requires fuel equal to 8000 barrels of the produced oil to generate about 1.8 million pounds per hour of 80% quality steam for the stimulation. The thermal efficiency of the steam generator is about 80 percent.

By the subject process, 10,000 bbls/day of recovered oil can be used to produce the same amount of steam and at the same time fuel a 140 megawatt power plant. Thus the subject process provides 3.36 million KWH of electrical energy from the additional 2000 bbls of oil processed. In the subject process, the conversion efficiency of oil of electricity is double that of a conventional power plant, i.e., 1680 KWH per barrel of oil compared to 720 KWH per barrel for a conventional oil-fired plant.

The process of the invention has been described generally and by examples with reference to an oil feedstock of particular composition for purposes of clarity and illustration only. It will be apparent to those skilled in the art from the foregoing that various modifications of the process and the materials disclosed herein can be made without departure for the spirit of the invention.

I claim:

1. In a process for the secondary recovery of oil by steam stimulation the improvement comprising: (1) reacting by partial oxidation in a free-flow synthesis gas generator at an autogenous temperature in the range of about 1500° to 3500° F and a pressure in the range of about 1 to 250 atmospheres absolute, a hydrocarbonaceous feed and a free-oxygen containing gas optionally in the presence of a temperature moderating gas to produce a raw fuel gas mixture comprising $H_2$, CO, $CO_2$, $H_2O$, particulate carbon and one or more members of the group $N_2$, $CH_4$, COS, $H_2S$, and A; (2) cooling the raw fuel gas mixture from (1) by indirect heat exchange with water to produce a stream of steam, and a separate stream of cooled raw fuel gas; (3) cleaning and purifying the cooled raw fuel gas stream from (2) in a gas cleaning and purification zone to produce a clean fuel gas comprising $H_2$, CO and one or more members of the group, $CO_2$, $N_2$, $CH_4$, and $H_2O$; (4) introducing into the combustion chamber of a gas turbine and burning therein the stream of clean fuel gas from (3) with air to produce a stream of clean flue gas; (5) passing the stream of clean flue gas from (4) through an expansion turbine as the working fluid to develop mechanical power or electrical energy or both; (6) passing a stream of treated water in indirect heat exchange with the stream of steam from (2) and a stream of exhaust flue gas from (5) in a steam generating zone, thereby converting said treated water into steam; (7) introducing a portion of the steam from (6) into a subterranean hydrocaron formation; (8) removing and separating a hydrocarbonaceous fluid and water from said subterranean formation; and (9) treating at least a portion of the water separated in (8) and recycling same into the steam generating zone in (6) as at least a portion of said treated $H_2O$.

2. The process of claim 1 provided with the additional steps of scrubbing the stream of cooled fuel gas from (2) with a liquid hydrocarbon scrubbing material to remove particulate carbon from the stream of fuel gas and to produce a dispersion of carbon and liquid hydrocarbon material; and introducing at least a portion of said dispersion into the gas generator in step (1) as at least a portion of the hydrocarbonaceous feed.

3. The process of claim 2 wherein said liquid hydrocarbon scrubbing material is a portion of said hydrocarbonaceous fluid recovered in step (8).

4. The process of claim 1 wherein said hydrocarbonaceous feed contains combined sulfur; said raw fuel gas in step (1) contains $H_2S$ and COS; and said $H_2S$ and COS are removed from the raw fuel gas in step (3).

5. The process of claim 1 wherein the free-oxygen containing gas in step (1) is selected from the group consisting of air, oxygen-enriched air (more than 21 mole percent $O_2$) and substantially pure oxygen (more than 95 mole percent $O_2$).

6. The process of claim 1 wherein said hydrocarbonaceous feed is a liquid hydrocarbon selected from the group consisting of petroleum distillates and residues, kerosine, crude petroleum, asphalt, gas oil, residual oil, tar-sand oil, shale oil, coal oil, coal tar, cycle gas oil from fluid-catalytic-cracking operation; furfural extract of coker gas oil, and mixtures thereof.

7. The process of claim 1 wherein said hydrocarbonaceous feed is a gaseous hydrocarbon selected from the group consisting of water gas, coke-oven gas, refinery gas, acetylene tail gas, ethylene off-gas, and mixtures thereof.

8. The process of claim 1 whereas said hydrocarbonaceous feed is an oxygenated hydrocarbonaceous organic material selected from the group consisting of carbohydrates, cellulosic materials, aldehydes, organic acids, alcohols, ketones, oxygenated fuel oil, waste liquids and by-products from chemical processes containing oxygenated hydrocarbonaceous organic materials and mixtures thereof.

9. The process of claim 1 wherein said hydrocarbonaceous feed is a pumpable slurry of solid carbonaceous fuels selected from the group consisting of coal, particulate carbon, petroleum coke, and concentrated sewer sludge; in a vaporizable carrier such as water, liquid hydrocarbon fuel, and mixtures thereof.

10. The process of claim 1 further provided with the step of preheating the hydrocarbonaceous feed to a temperature up to 1200° F but below its cracking temperature prior to introducing said fuel into the gas generator in step (1).

11. The process of claim 1 wherein the steam from step (6) is injected into the subterranean hydrocarbon formation in step (7) by way of at least one injection well; and the hydrocarbonaceous fluid and water are removed from said subterranean formation in step (8) by way of at least one producing well.

12. The process of claim 1 wherein the steam from step (6) is injected into the subterranean hydrocarbon formation in step (7) by way of an injection well, and the hydrocarbonaceous fluid and water are removed from said subterranean formation in step (8) by way of the same well after the same injection has stopped.

13. In a process for the secondary recovery of oil by steam stimulation the improvement comprising:

(1) reacting by partial oxidation in a free-flow synthesis gas generator at an autogenous temperature in the range of about 1500° to 3500° F. and a pressure in the range of about 1 to 250 atmospheres absolute, a hydrocarbonaceous feed and a free-oxygen containing gas optionally in the presence of a temperature moderating gas to produce a raw fuel gas mixture comprising $H_2$, CO, $CO_2$, $H_2O$, particulate carbon and one or more members of the group $N_2$, $CH_4$, COS, $H_2S$, and A; (2) passing the hot raw fuel gas mixture from (1) in noncontact indirect heat exchange with a separate stream of hot clean exhaust flue gas, and a separate stream of treated water, thereby producing a stream of steam, and separate streams of cooled raw fuel gas and clean exhaust flue gas; (3) cleaning and purifying the raw fuel gas stream from (2) in a gas cleaning and purification zone to produce a clean fuel gas comprising $H_2$, $CH_4$, CO, $CO_2$ and $H_2O$; (4) introducing into the combustion chamber of a gas turbine and burning therein the stream of clean fuel gas from (3) with air to produce a stream of clean flue gas; (5) passing the stream of clean flue gas from (4) through an expansion turbine as the working fluid to develop mechanical power or electrical energy or both and then into step (2) as said stream of hot clean exhaust flue gas; (6) introducing at least a portion of the steam from (2) into a subterranean hydrocarbon formation; (7) removing and separating a hydrocarbonaceous fluid and water from said subterranean formation; and (8) treating at least a portion of the water separated in (7) and recycling same to (2) as at least a portion of said treated water.

14. The process of claim 13 provided with the additional steps of scrubbing the stream of cooled fuel gas from (2) with a portion of the recovered hydrocarbonaceous fluid to remove particulate carbon from the stream of fuel gas and to produce a dispersion of carbon and hydrocarbonaceous fluid; and introducing at least a portion of said dispersion into the gas generator in step (1) as at least a portion of the hydrocarbonaceous feed.

15. A process for the secondary recovery of oil by steam stimulation comprising: (1) reacting by partial oxidation in a free-flow synthesis gas generator at an autogenous temperature in the range of about 1500° to 3500° F and a pressure in the range of about 1 to 250 atmospheres absolute, a hydrocarbonaceous feed and a free-oxygen containing gas optionally in the presence of a temperature moderating gas to produce a raw fuel gas mixture comprising $H_2$, CO, $CO_2$, $H_2O$, particulate carbon and one or more members of the group $N_2$; $CH_4$, COS, $H_2S$, and A; (2) passing the hot raw fuel gas mixture from (1) in indirect heat exchange with a separte stream of preheated treated water, thereby producing a stream of steam, and a separate stream of cooled raw fuel gas; (3) cleaning and purifying the cooled raw fuel gas stream from (2) in a gas cleaning and purification zone to produce a clean fuel gas comprising $H_2$, CO and one or more members of the group $N_2$, $CO_2$, $CH_4$, and $H_2O$; (4) introducing into the combustion chamber of a gas turbine and burning therein the stream of clean fuel gas from (3) with air to produce a stream of clean flue gas; (5) passing the stream of clean flue gas from (4) through an expansion turbine as the working fluid to develop mechanical power or electrical energy or both; (6) passing a portion of the exhaust flue gas stream from (5) in indirect heat exchange with a stream of treated water to produce the preheated treated water in (2); (7) introducing at least a portion of the steam from (2) into a subterranean formation; (8) removing and separating a hydrocarbonaceous fluid and water from said subterranean formation; and (9) treating at least a portion of the water separated in (8) and recycling same to (6) as at least a portion of said treated water.

16. The process of claim 15 provided with the additional steps of scrubbing the stream of cooled raw fuel gas from (2) with a portion of the recovered hydrocarbonaceous fluid to remove particulate carbon from the stream of fuel gas and to produce a dispersion of carbon and hydrocarbonaceous fluid; and introducing at least a portion of said dispersion into the gas generator in step (1) as at least a portion of the hydrocarbonaceous feed.

17. In a process for the secondary recovery of oil by steam stimulation the improvement comprising: (1) reacting by partial oxidation in a free-flow synthesis gas generator at an autogenous temperature in the range of about 1500° to 3500° F. and a pressure in the range of about 1 to 250 atmospheres absolute, a hydrocarbonaceous feed and a free-oxygen containing gas optionally in the presence of a temperature moderating gas to produce a raw fuel gas mixture comprising $H_2$, CO, $CO_2$, $H_2O$, Particulate carbon and one or more members of the group $N_2$, $CH_4$, COS, $H_2S$, and A; (2) cooling the raw fuel gas mixture from (1) to a temperature in the range at about 300° to 750° F. in a first heat exchange zone by indirect heat exchange with condensed steam to produce a stream of steam for circulating as heat transfer fluid in a closed loop, and a separate stream of cooled raw fuel gas; (3) cleaning and purifying the cooled raw fuel gas stream from (2) in a gas cleaning and purification zone to produce a clean fuel gas comprising $H_2$, CO and one or more members of the group, $CO_2$, $N_2$, $CH_4$, and $H_2O$; (4) introducing into the combustion chamber of a gas turbine and burning therein the stream of clean fuel gas from (3) with air to produce a stream of clean flue gas; (5) passing the stream of clean flue gas from (4) through an expansion turbine as the working fluid to develop mechanical power or electrical energy or both; (6) passing through a second heat exchange zone a stream of treated water in indirect heat exchange with the stream of heat transfer steam from (2) circulating in said closed loop, and a stream of exhaust flue gas from (5) at a temperature in the range of about 800° to 1200° F., thereby converting said treated water into a stream of process steam while cooling and condensing the stream of heat transfer steam, recycling said condensed steam to step (1), and discharging and cooled clean exhaust flue gas to the atmosphere; (7) introducing at least a portion of the process steam from (6) into a subterranean hydrocarbon formation; (8) removing and separating a hydrocarbonaceous fluid and water from said subterranean formation; and (9) treating at least a portion of the water separated in (8) and recycling same into the second heat exchange zone in (6) as at least a portion of said treated water.

* * * * *